US007223208B1

(12) United States Patent
Chen et al.

(10) Patent No.: US 7,223,208 B1
(45) Date of Patent: May 29, 2007

(54) EXERCISE MACHINE COMPRISING TWO HAND GRIPS WHICH ARE PROVIDED WITH A DAMPING DEVICE

(75) Inventors: Ya-Chi Chen, 4F., No. 51, Lane 62, Jhengyi S. Rd., Sanchong City, Taipei County (TW); Chang-Hsin Yang, Taichung Hsien (TW); Hsiung-Yao Yang, Taichung Hsien (TW)

(73) Assignee: Ya-Chi Chen, Sanchong, Taipei County (TW)

( * ) Notice: Subject to any disclaimer, the term of this patent is extended or adjusted under 35 U.S.C. 154(b) by 542 days.

(21) Appl. No.: 10/656,963

(22) Filed: Sep. 8, 2003

(51) Int. Cl.
*A63B 22/00* (2006.01)
*A63B 22/04* (2006.01)
*A63B 21/00* (2006.01)

(52) U.S. Cl. ..... 482/52; 482/57; 482/905

(58) Field of Classification Search ..... 482/52, 482/57, 70, 905, 51, 148
See application file for complete search history.

(56) References Cited

U.S. PATENT DOCUMENTS 3,475,021 A * 10/1969 Ruegsegger ..... 482/71
3,662,602 A * 5/1972 Weiss ..... 73/379.08
4,509,747 A * 4/1985 Martin ..... 482/123
5,842,958 A * 12/1998 Rufa ..... 482/112
6,277,055 B1 * 8/2001 Birrell et al. ..... 482/52
6,821,232 B1 * 11/2004 Wang et al. ..... 482/52

* cited by examiner

*Primary Examiner*—Stephen R. Crow
(74) *Attorney, Agent, or Firm*—Egbert Law Offices

(57) ABSTRACT

An exercise machine includes a base, a machine frame mounted on the base, and one or more hand grips pivoted to the machine frame. Each of the hand grips is provided with a damping device which is fastened at one end to the base or machine frame, and at the other end to a bottom end of the hand grip.

1 Claim, 8 Drawing Sheets

EXERCISE MACHINE COMPRISING TWO HAND GRIPS WHICH ARE PROVIDED WITH A DAMPING DEVICE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to an exercise machine, and more particularly to a damping mechanism of two hand grips of the exercise machine. The hand grips are thus provided with a damping effect independently.

BACKGROUND OF THE INVENTION

The conventional exercise machines are generally formed of two hand grips, which are fastened fixedly or pivotally with the machine body to facilitate the balancing of the body of an exerciser. Such a conventional hand grip structure as described above is defective in design in that it is ineffective in providing a user of the machine with a means to balance his or her body at such time when the user of the machine is in motion. In other words, the conventional hand grips are capable of acting to balance the body of the user of the machine at the time when the exerciser is in a stationary state. The case in point is the conventional leg exercising machine comprising two hand grips capable of moving along an oval track. The swinging motion of the hand grips cannot be properly coordinated with the adjustment in dynamic balance of the exerciser. In addition, the swinging range of the hand grips, the onset of the swinging motion of the hand grips, and the timing of the swinging motion of the hand grips cannot be properly modified.

BRIEF SUMMARY OF THE INVENTION

The primary objective of the present invention is to provide two hand grips of an exercise machine with a damping device enabling the hand grips to swivel independently, so as to provide a user of the exercise machine with an effective means to balance the body of the user of the exercise machine.

The features and the advantages of the present invention will be more readily understood upon a thoughtful deliberation of the following detailed description of the preferred embodiments of the present invention with reference to the accompanying drawings.

DETAILED DESCRIPTION OF THE INVENTION

Figure 1:
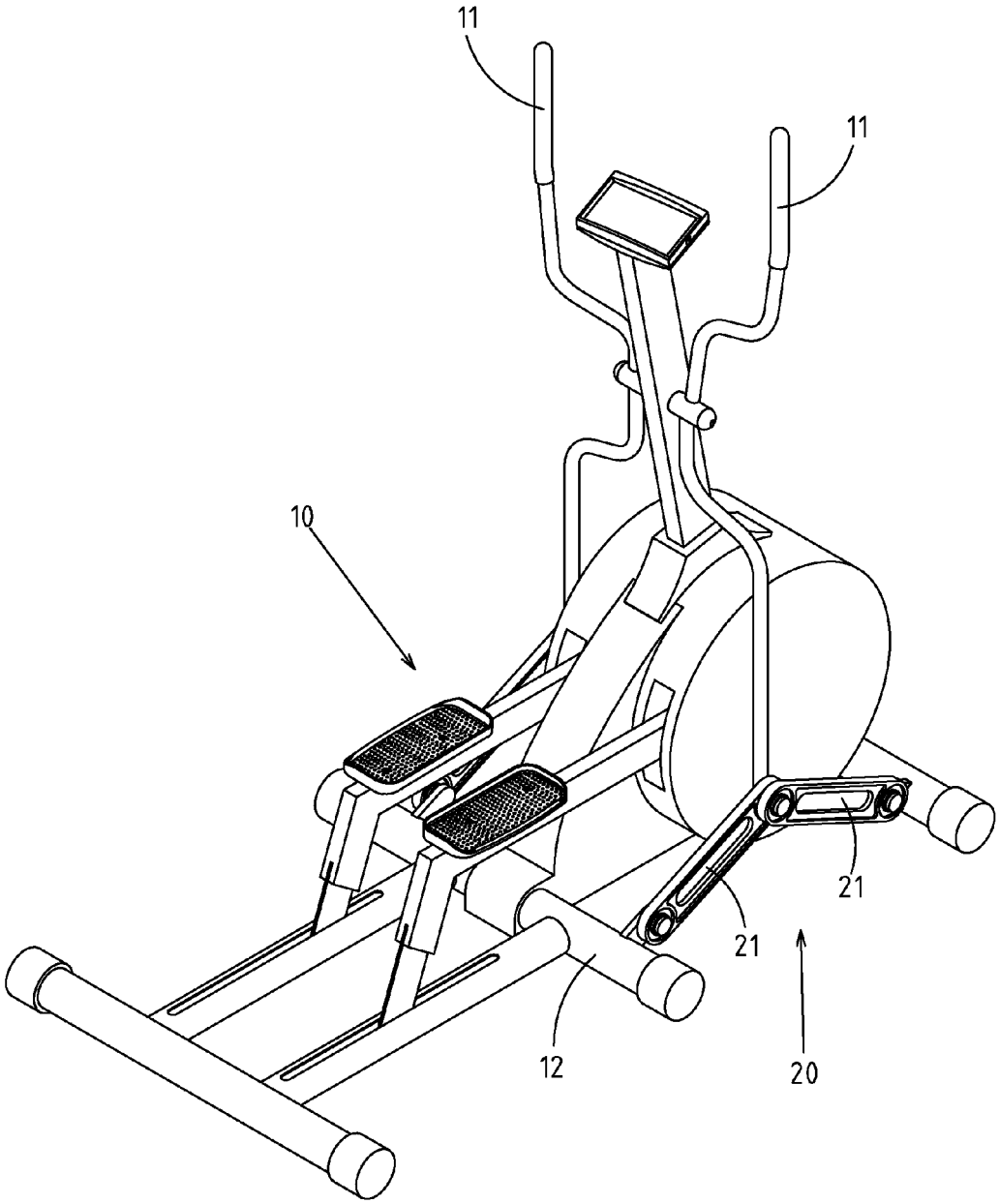
FIG. 1 shows a perspective view of a first preferred embodiment of the present invention.
Figure 3:
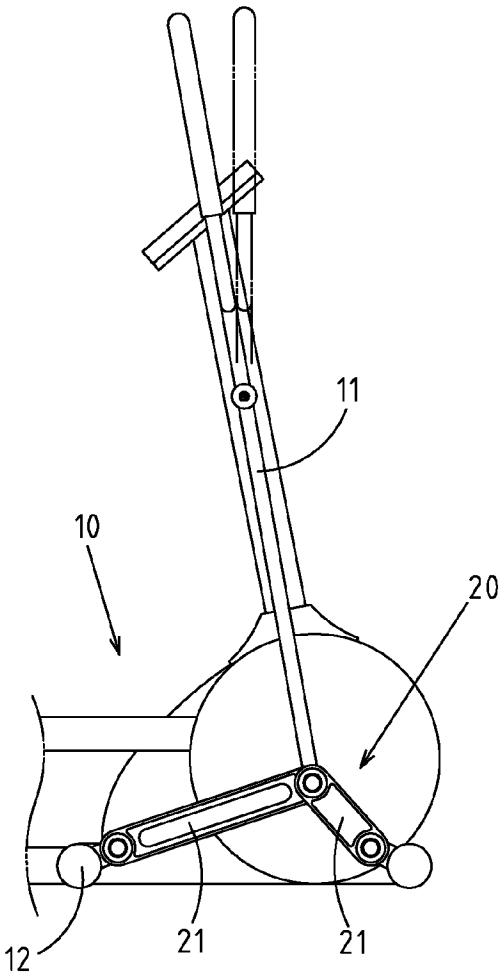
FIG. 3 shows a side schematic view of the first preferred embodiment of the present invention in action.
Figure 2:
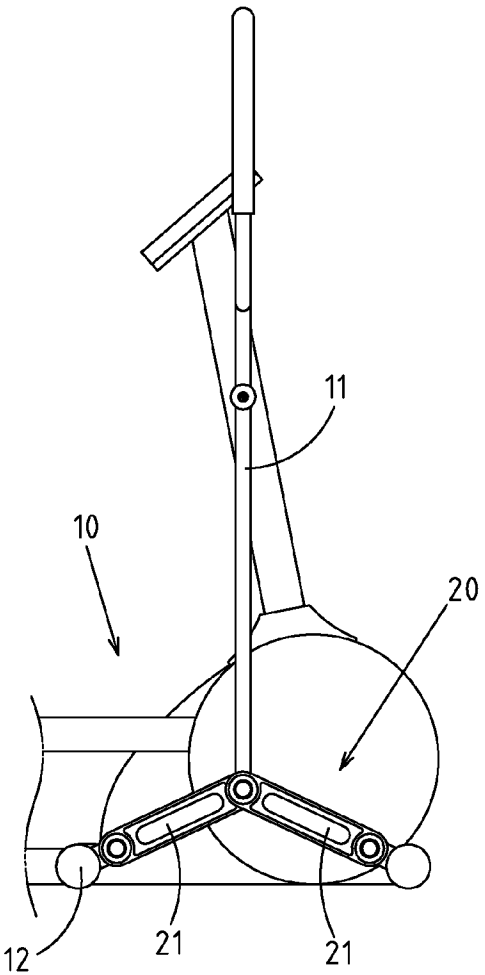
FIG. 2 shows a side schematic view of the first preferred embodiment of the present invention.
Figure 4:
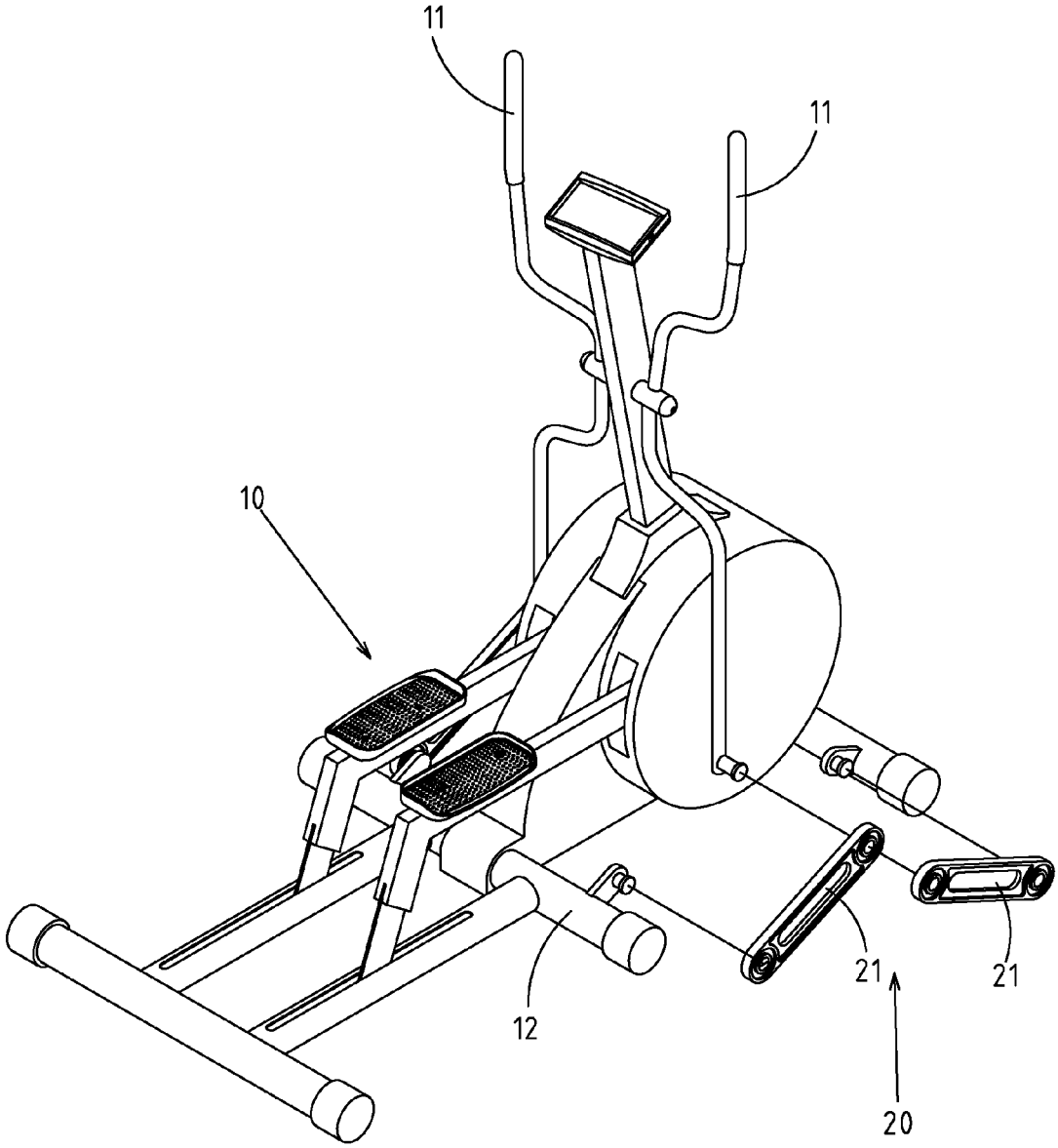
FIG. 4 shows an exploded perspective view of the first preferred embodiment of the present invention.

As shown in FIGS 1–4, an exercise machine 10 of the present invention comprises two hand grips 11, each being provided with a damping device 20. The exercise machine 10 has a base 12 on which the hand grips 11, the two damping devices 20, and other mechanisms are mounted. The two hand grips 11 are capable of swinging in such a way that the swinging action of the hand grips 11 is dampened by the damping device 20.

The damping devices 20 are formed of two tension elements 21. The tension elements 21 of the present invention are two endless rubber belts, as shown in FIGS 1–4.

Figure 5:
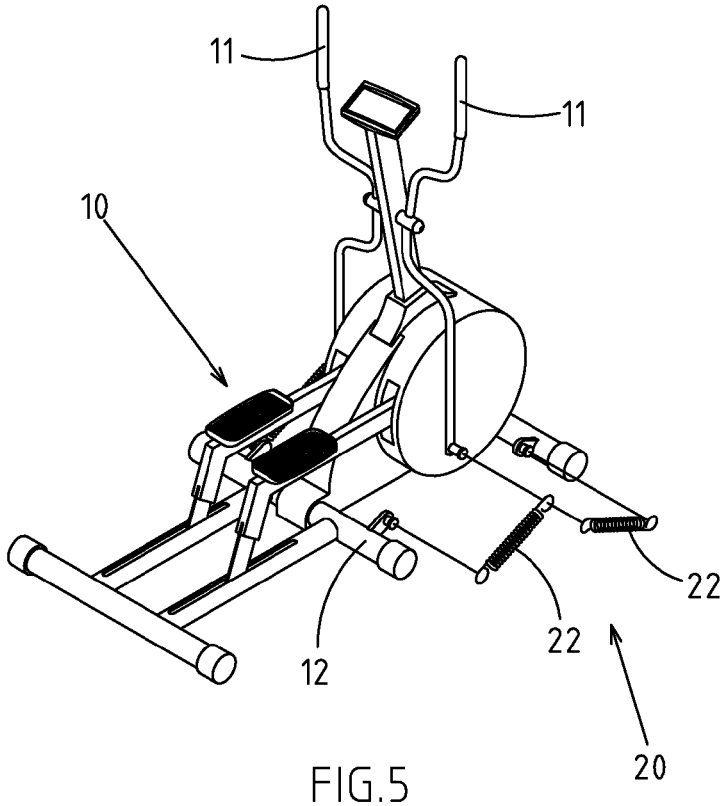
FIG. 5 shows an exploded perspective view of a second preferred embodiment of the present invention.

The damping devices 20 of the present invention are of two tension springs 22 in place of the endless rubber belts 21, as shown in FIG. 5.

Figure 6:
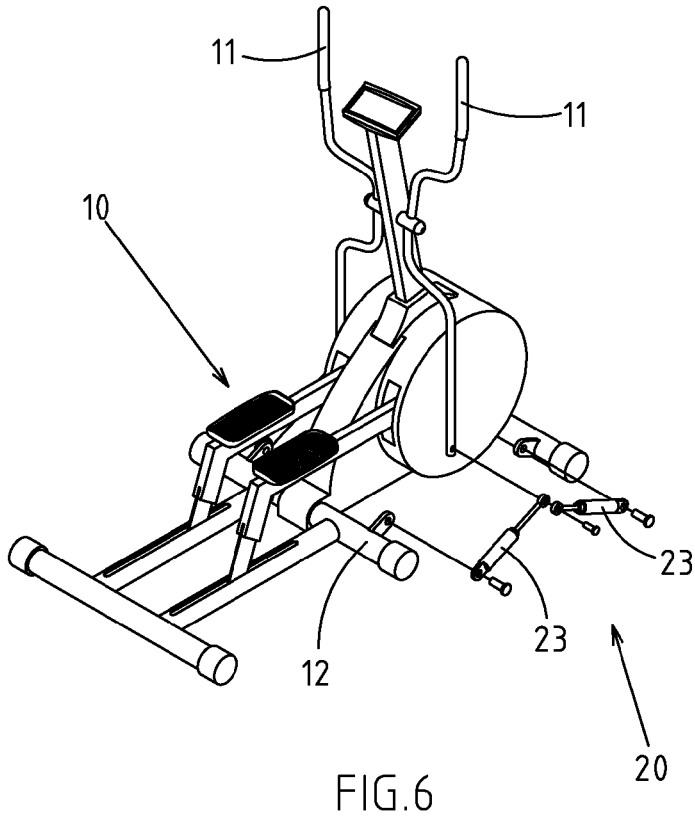
FIG. 6 shows an exploded perspective view of a third preferred embodiment of the present invention.

As shown in FIG. 6, the damping devices 20 of the present invention are formed of two pneumatic rods 23.

Figure 7:
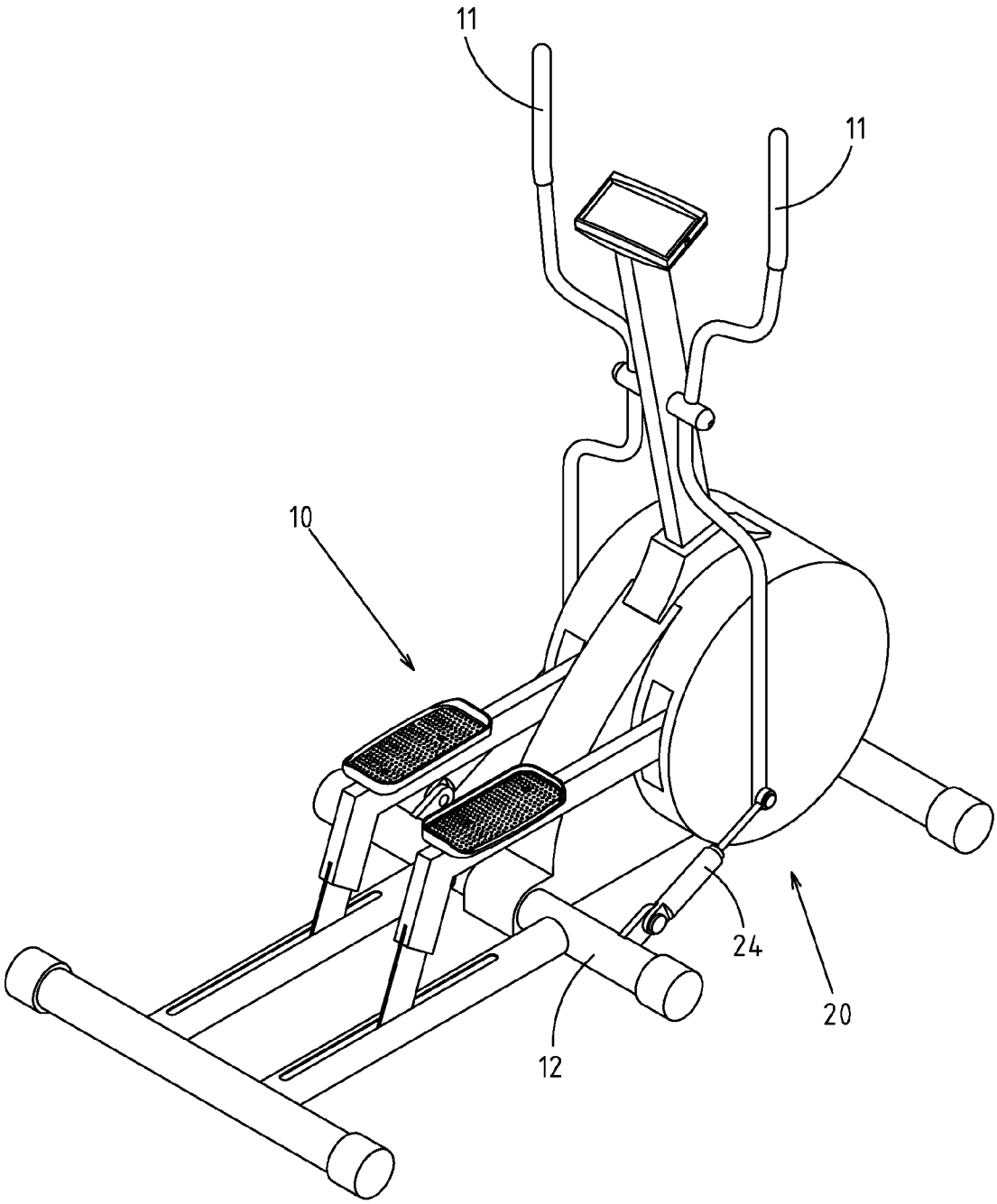
FIG. 7 shows a perspective view of a fourth preferred embodiment of the present invention.

As shown in FIG. 7, the damping devices 20 of the present invention are formed of a pneumatic bar 24, which is capable of dual-direction damping effect. The pneumatic bar 24 is fastened at one end with the base 12, and at the other end with one end of the hand grips 11.

Figure 8:
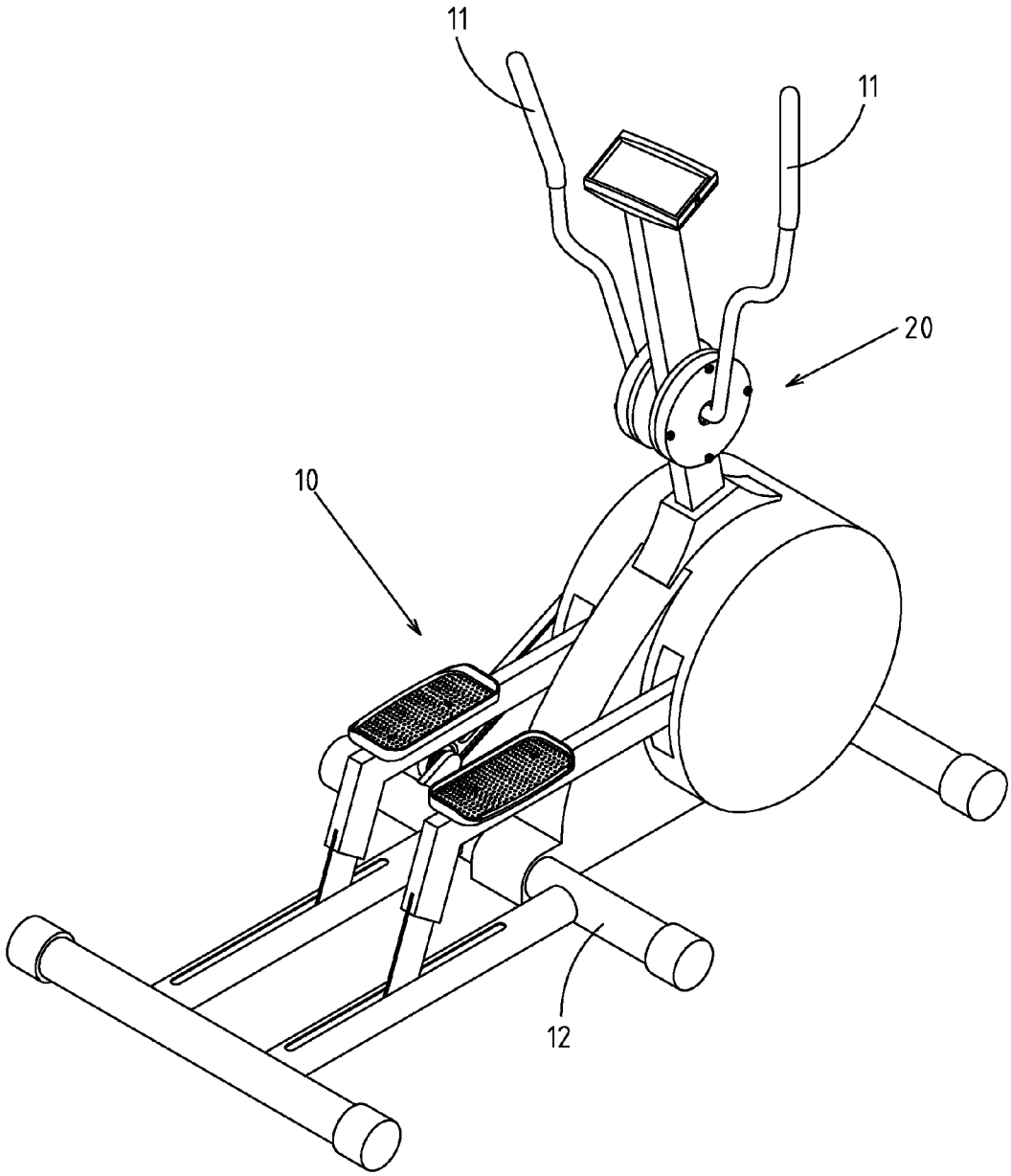
FIG. 8 shows a perspective view of a fifth preferred embodiment of the present invention.
Figure 9:
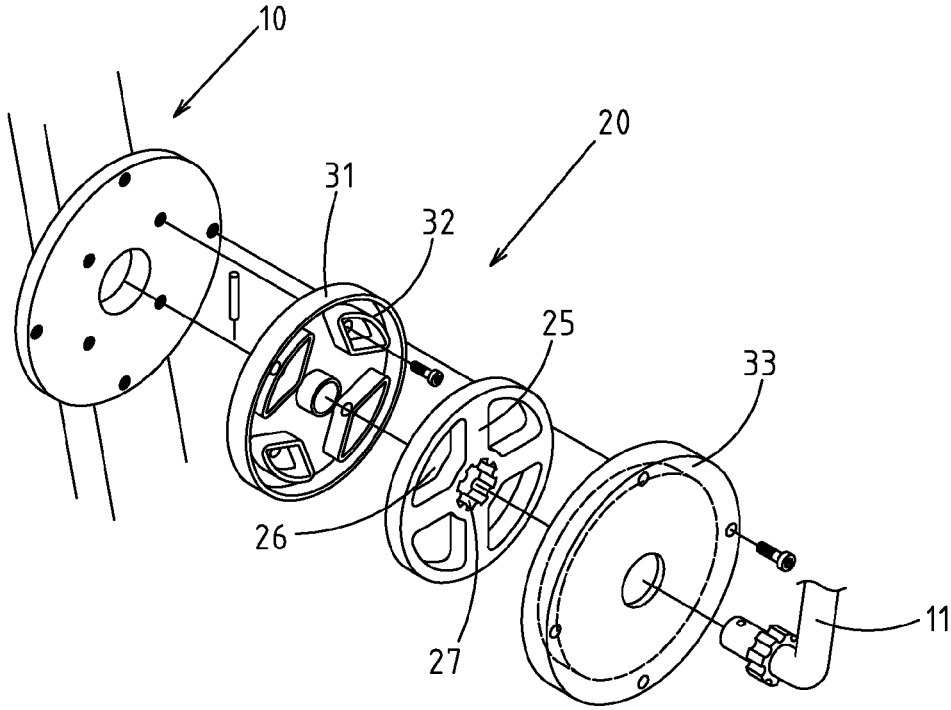
FIG. 9 shows a partial exploded perspective view of the fifth preferred embodiment of the present invention.
Figure 10:
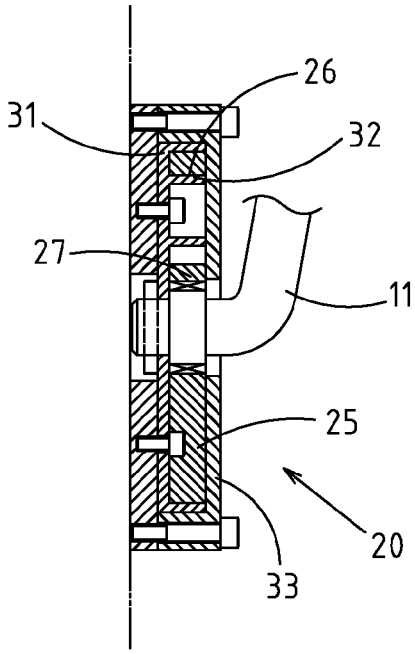
FIG. 10 shows a partial sectional view of the fifth preferred embodiment of the present invention.

As shown in FIGS. 8–10, the damping devices 20 of the present invention comprises a torsion element 25, a confinement disk 31, and a shield 33. The torsion element 25 of a rubber material is provided with a plurality of retaining slots 26 and an engagement hole 27. The confinement disk 31 is provided with a plurality of retaining portions 32 corresponding in location and number to the retaining slots 26 of the torsion element 25. The torsion element 25 is disposed between the confinement disk 31 and the shield 33 such that the retaining portions 32 of the confinement disk 31 are retained in the retaining slots 26 of the torsion element 25, and that the engagement hole 27 of the torsion element 25 is engaged with one end of the hand grip 11.

Figure 11:
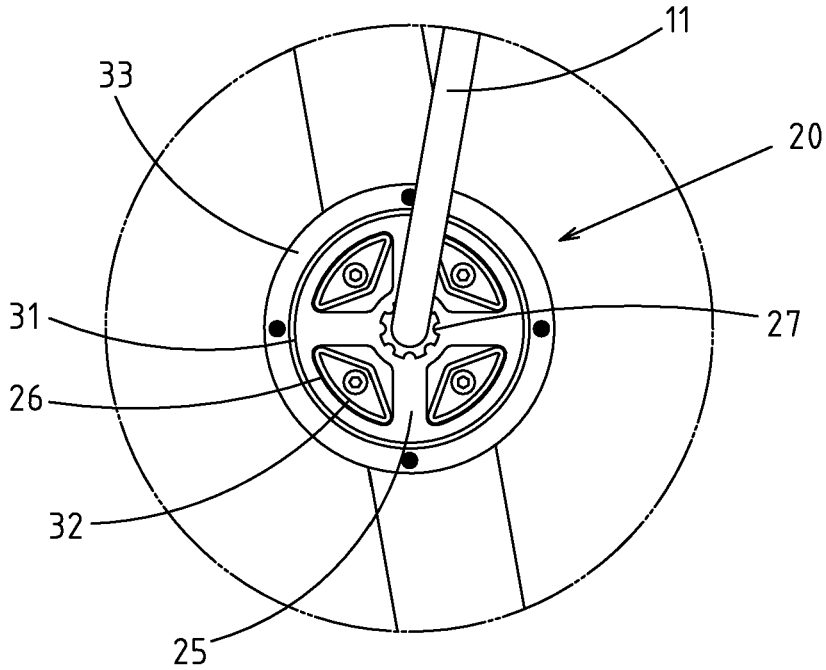
FIG. 11 shows a partial side schematic view of the fifth preferred embodiment of the present invention.
Figure 12:
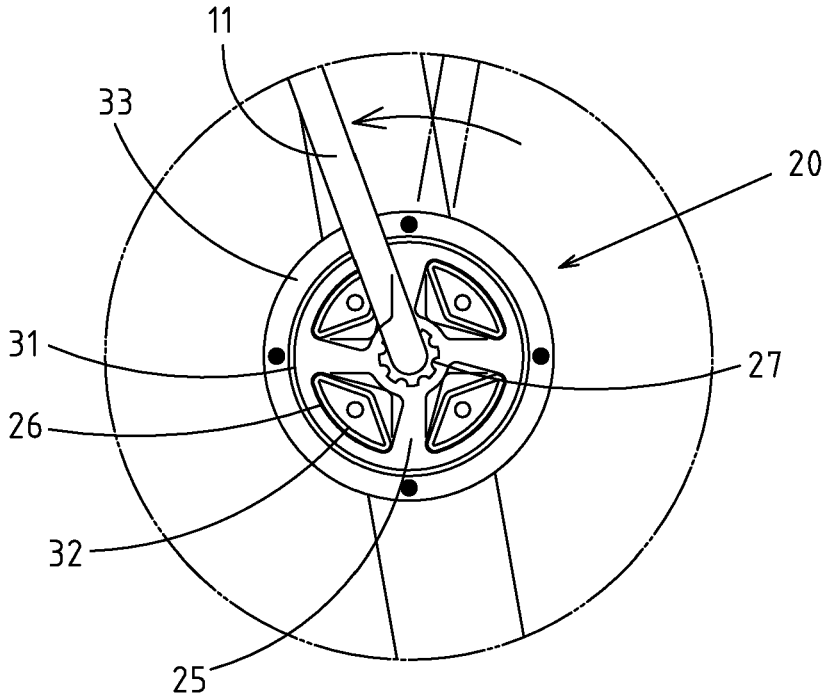
FIG. 12 shows a partial side schematic view of the fifth preferred embodiment of the present invention in action.

As illustrated in FIGS. 11 and 12, the damping effect is brought about by the torsion element 25. Meanwhile, the torsion element 25 serves to provide the hand grip 11 with a recovery force.

The swinging amplitude and mode of the hand grips 11 of the present invention can be thus adjusted in conjunction with the motion state of a user of the exercise machine 10 by virtue of the damping devices 20. In addition, the operational flexibility and independence of the hand grips 11 are enhanced by the damping devices 20.

It must be noted here that the rubber belts 21, the tension springs 22, and the pneumatic rods 23 of the present invention are capable of providing not only the damping effect but also the recovery force.

In light of the nature of dual-directional damping effect of the pneumatic bar 24 of the present invention, the damping devices 20 of the present invention are cost-effective by virtue of the fact that the number of the pneumatic bar 24 is reduced.

The torsion element 25 of the rubber material is effective in providing the hand grip 11 with both damping effect and recovery force.

It is therefore readily apparent that the damping devices 20 of the present invention enhance effectively and economically the operational flexibility and independence of the hand grips 11. Moreover, the magnitudes of the damping effect and the recovery force of the hand grips 11 can be feasibly adjusted by an increase or reduction in number of the damping devices 20.

The embodiments of the present invention described above are merely illustrative. Accordingly, the present invention may be embodied in other specific forms without deviating from the spirit thereof. The present invention is therefore to be limited only by the scope of the following claims.

We claim:

1. An elliptical exercise machine comprising:

a base having a first connector and a second connector in spaced relation to each other;

a machine frame mounted on said base, said machine frame having foot supports formed thereon at a position above said base and located between ends of said base for a closed loop movement thereon;

a pair of hand grips pivotally mounted to said machine frame at a location forward of and above said foot supports, each of said pair of hand grips having a handle at an upper end thereof above the pivotal mounting, each of said pair of hand grips having a lower end with a mounting rod extending transversely outwardly therefrom at a location below the pivotal mounting;

a first endless rubber belt having one end affixed to said mounting rod and an opposite end affixed to said first connector; and a second endless rubber belt having one end affixed to said mounting rod and an opposite end affixed to said second connector, said first endless rubber belt being resistive of a forward movement of said handle, said second endless rubber belt being resistive of a rearward movement of said handle.

* * * * *